United States Patent [19]

Lenk et al.

[11] Patent Number: 4,880,177

[45] Date of Patent: Nov. 14, 1989

[54] YARN WITHDRAWAL APPARATUS

[75] Inventors: Erich Lenk, Remscheid; Albert Stitz, Kürten, both of Fed. Rep. of Germany

[73] Assignee: Barmag, AG, Remscheid, Fed. Rep. of Germany

[21] Appl. No.: 266,472

[22] Filed: Nov. 2, 1988

Related U.S. Application Data

[63] Continuation-in-part of Ser. No. 218,089, Jul. 12, 1988, which is a continuation-in-part of Ser. No. 38,334, Apr. 14, 1987, Pat. No. 4,817,880, which is a continuation-in-part of Ser. No. 8,490, Jan. 29, 1987, Pat. No. 4,784,344.

[30] Foreign Application Priority Data

Nov. 7, 1987 [DE] Fed. Rep. of Germany ..... 3737960
Jun. 9, 1988 [DE] Fed. Rep. of Germany ..... 3819677

[51] Int. Cl.[4] ..... B65H 51/20

[52] U.S. Cl. ..... 242/47.01; 242/18 R; 242/47; 242/47.03; 226/97; 28/289

[58] Field of Search ..... 242/47.01, 47.03, 47.04, 242/47.05, 47.06, 47.07, 47.08, 47.09, 47.1, 47.11, 47.12, 47.13, 47, 18 R, 18 A, 18 PW; 226/97, 108, 168, 184; 28/289

[56] References Cited

U.S. PATENT DOCUMENTS

| | | | |
|---|---|---|---|
| 1,962,029 | 6/1934 | Murphy et al. | 226/184 |
| 2,350,182 | 5/1944 | Neff | 242/47.09 X |
| 2,539,978 | 1/1951 | Van Dijk | 226/184 |
| 2,667,052 | 1/1954 | Lebocey | 242/47.01 X |
| 2,744,399 | 5/1956 | West | 242/47.12 |
| 2,885,257 | 5/1959 | Courtney et al. | 226/97 X |
| 2,929,179 | 3/1960 | George | 28/289 |
| 3,083,924 | 4/1963 | Vossen et al. | 242/47.12 |
| 3,144,187 | 8/1964 | Naumann | 226/97 |
| 3,272,416 | 9/1966 | Emery | 226/97 |
| 3,433,424 | 3/1969 | Rover et al. | 242/47 |
| 3,706,407 | 12/1972 | King et al. | 226/97 |
| 3,912,185 | 10/1975 | Yamada | 242/47.03 |
| 3,915,403 | 10/1975 | King | 242/47.01 |
| 3,917,141 | 11/1975 | Sartori | 242/97 |
| 3,957,217 | 5/1976 | Clemens | 242/47.01 |
| 4,127,983 | 12/1978 | Munker | 226/97 |
| 4,372,498 | 2/1983 | Van Mullekom | 242/47.01 |
| 4,614,311 | 9/1986 | Kakinaka | 242/47.01 |
| 4,638,955 | 1/1987 | Schippers et al. | 242/18 PW |

FOREIGN PATENT DOCUMENTS

| | | |
|---|---|---|
| 185131 | 4/1985 | European Pat. Off. . |
| 241850 | 4/1987 | European Pat. Off. . |
| 1911735 | 6/1970 | Fed. Rep. of Germany . |
| 2633474 | 2/1978 | Fed. Rep. of Germany . |
| 2939716 | 4/1981 | Fed. Rep. of Germany . |
| 3115371 | 2/1982 | Fed. Rep. of Germany . |
| 2302951 | 10/1976 | France . |
| 861140 | 2/1961 | United Kingdom . |
| 1057118 | 2/1967 | United Kingdom . |
| 2092188A | 6/1981 | United Kingdom . |
| 2169927A | 1/1986 | United Kingdom . |

*Primary Examiner*—Stanley N. Gilreath
*Attorney, Agent, or Firm*—Bell, Seltzer, Park & Gibson

[57] ABSTRACT

A yarn withdrawal apparatus is disclosed for temporarily withdrawing a freshly spun and continuously advancing yarn to a waste container when the spinning operation is interrupted, and for thereafter threading the yarn onto the feed godet or winder of the spinning machine. The apparatus comprises a yarn advancing means in the form of a rotating roll, a yarn delivery tube including a yarn outlet opening, a yarn suction tube including a yarn inlet opening, and with the yarn delivery tube and yarn suction tube being mounted so as to permit relative rotation thereof about the axis of the roll and between a yarn catching position wherein the outlet opening and inlet opening are aligned, and a drawing-off position. Thus the relative rotation causes a yarn passing from the delivery tube to the suction tube to be at least partially looped about the rotating roll.

16 Claims, 6 Drawing Sheets

YARN WITHDRAWAL APPARATUS

CROSS-REFERENCE TO RELATED APPLICATIONS

The present application is a continuation-in-part of copending application Ser. No. 218,089, filed July 12, 1988, which in turn is a continuation-in-part of copending application Serial No. 083,334, filed Apr. 14, 1987, now, U.S. Pat. No 4,817,880 which in turn is a continuation-in-part of copending application Ser. No. 008,490, filed Jan. 29, 1987, now U.S. Pat. No. 4,784,344.

BACKGROUND OF THE INVENTION

The present invention relates to a yarn withdrawal apparatus for use with a yarn processing apparatus of the type which continuously processes and advances a yarn along a predetermined path of travel, and wherein the withdrawal apparatus is adapted to continuously withdraw the advancing yarn from the path of travel when the operation of the processing machine is interrupted, to facilitate yarn thread-up and the like.

The above copending applications disclose apparatus of the described type and which are adapted to apply a relatively high yarn tension to the advancing yarn, at speeds of up to 4,000 meters per minute and above. Also, as is indicated in the above copending applications, it is not a significant problem to catch a delivered yarn end with a suction gun or an air current, when the yarn is advancing directly from the spinneret. However, the prior applications also recognize that a relatively high tension is necessary to prevent laps from forming on the yarn delivery system positioned downstream of the spinneret, and the required high tension may be achieved when the air current is assisted by a mechanical yarn advancing system.

It is an object of the present invention to provide an improved yarn withdrawal apparatus of the described type, and which provides for a reliable catching of the delivered yarn end in the air current.

It is also an object of the present invention to provide an improved yarn withdrawal apparatus which is simple to operate and which permits the captured yarn to be readily looped about the yarn delivery system of the yarn processing machine, without risk of lap formation.

SUMMARY OF THE PRESENT INVENTION

The above and other objects and advantages of the present invention are achieved in the embodiments illustrated herein by the provision of a yarn withdrawal apparatus which comprises a support structure, yarn advancing means mounted to the support structure and comprising at least one rotatable roll, and drive means mounted to the support structure for rotating the roll at a predetermined rotational speed. The apparatus further comprises a yarn delivery tube including a yarn outlet opening, a yarn suction tube including a yarn inlet opening, and suction means for drawing air into said suction tube through the inlet opening. Means are also provided for mounting the yarn delivery tube and the yarn suction tube to the support structure so as to permit relative rotation of the yarn outlet and the yarn inlet opening in the circumferential direction about the roll and between (a) a yarn catching position wherein the yarn outlet opening and the yarn inlet opening are disposed immediately adjacent to each other and aligned along a direction substantially parallel to the axial direction of the roll, and (b) a drawing-off position. Thus the relative rotation causes a yarn passing from the yarn delivery tube to the yarn suction tube to be at least partially looped about the roll.

In the preferred embodiments, the yarn advancing means may comprise one or more rolls, of which at least one is rotatably driven. Also, it is preferred that both the yarn delivery tube and the yarn suction tube extend substantially parallel to a surface line of one of the rolls.

The inlet and outlet openings may be located in closely adjacent parallel planes, so that the front faces of the openings form only a very narrow gap, which permits the relative movement. A substantially airtight contact of the openings of the two tubes is possible in the yarn catching position, if both openings are arranged obliquely to the normal plane, so that in the catching position the openings are in substantially sealed relationship to the other.

The relative rotational movement of the suction inlet opening and the yarn delivery tube preferably occurs only in a plane which is normal to the rotational axis of the roll of the delivery system, i.e., without an axial advance. This not only simplifies the construction and operation of the yarn withdrawal apparatus, but it also contributes to a smooth yarn path.

In order to prevent a yarn length which leaves the yarn delivery tube, and a yarn length which enters into the suction inlet opening, from contacting each other, it is further preferred that the angle of the relative rotational movement be less than 360°.

The particular value of the rotational angle is determined from the desired effect on the yarn advancement, the smooth run of the yarn being also of importance. By experience, rotational angles smaller than 120°, are not usually preferred because of the too little frictional contact with the yarn. On the other hand, it is found that a looping angle of approximately 360°, and wherein the yarn advances only in one normal plane, is not only adequate, but also favorable for the smooth run of the yarn.

The relative rotation of the yarn outlet opening and the yarn inlet opening may be provided by mounting the yarn delivery tube so as to be stationary and with the yarn inlet opening of the suction tube being rotatably mounted, or alternatively, the yarn suction tube may be stationary, with the yarn outlet opening of the yarn delivery tube being rotatable. Where the yarn delivery tube is stationary and the inlet opening of the suction tube is rotatable, high yarn tensions, which may cause the yarn to be pulled from the suction tube, are prevented by providing that the suction tube rotates in the direction of rotation of the yarn advancing roll. Where the suction tube is stationary and the yarn delivery tube is rotatable, the rotation of the delivery tube preferably occurs opposite to the direction of rotation of the roll, so as to avoid unusually high yarn tensions.

The yarn withdrawal apparatus of the present invention also has the advantage that it may be constructed as a compact unit which can be readily moved as a hand operated device, for withdrawing the yarn from the yarn processing apparatus and effecting subsequent thread-up.

BRIEF DESCRIPTION OF THE DRAWINGS

Some of the objects and advantages of the present invention having been stated, others will be more fully understood from the detailed description which follows and by reference to the accompanying drawings in which.

DETAILED DESCRIPTION OF THE PREFERRED EMBODIMENT

Figure 1:
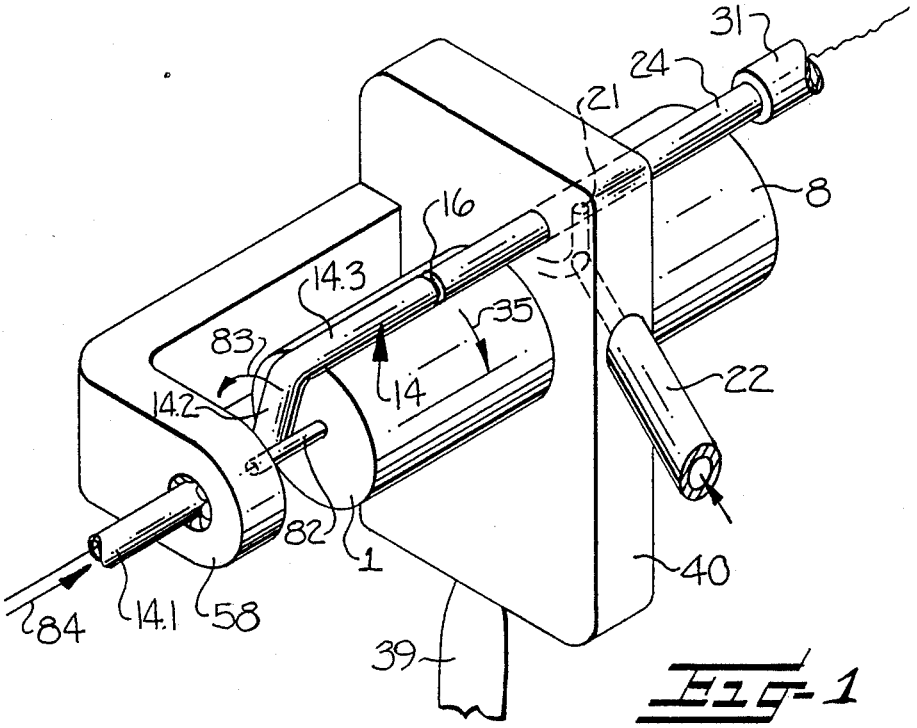
FIGS. 1 and 2 are perspective views of a first embodiment of the yarn withdrawal apparatus of the present invention, with FIG. 1 illustrating the yarn catching position and FIG. 2 illustrating the drawing-off position.
Figure 1A:
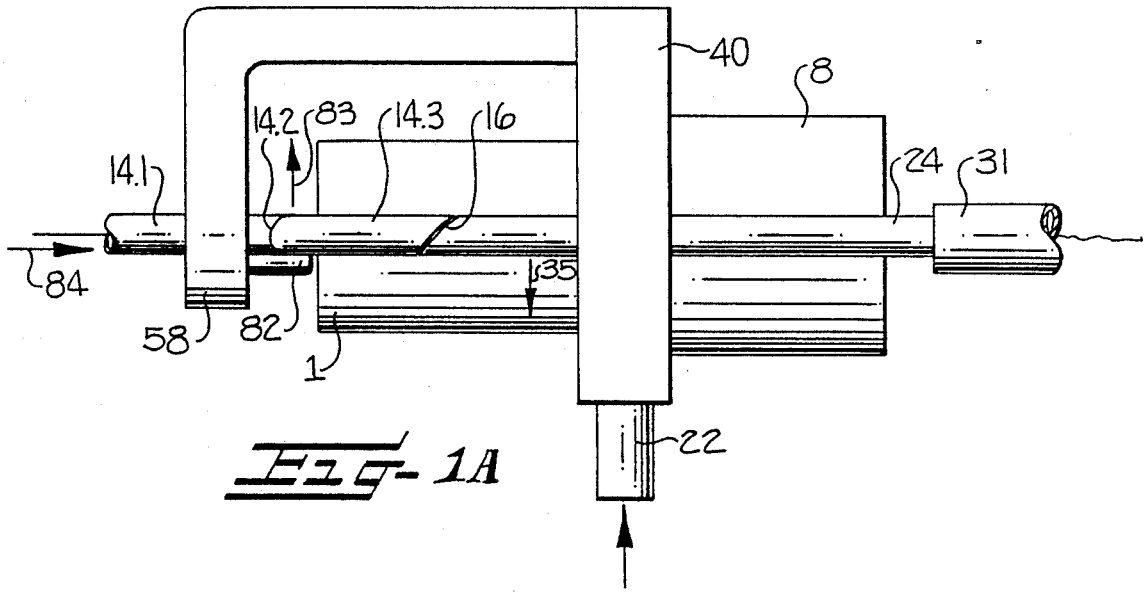
FIG. 1A is a plan view of a modified embodiment of the invention.
Figure 2:
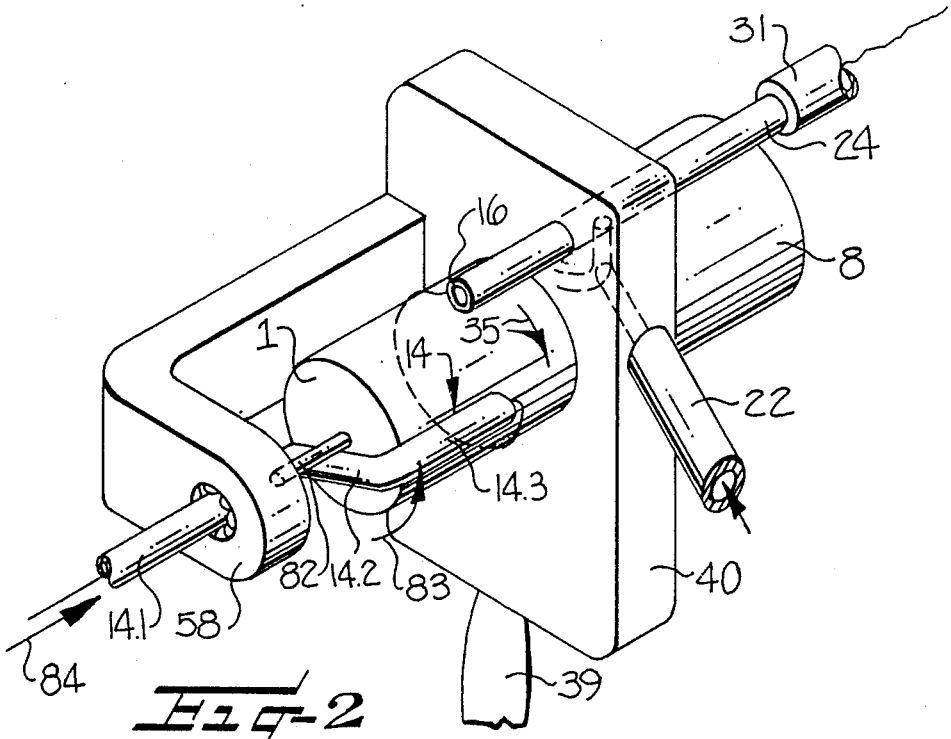

FIGS. 1, 1A, and 2 illustrate a yarn withdrawal apparatus, in which the yarn delivery tube is rotatable about a stationary yarn delivery system. Illustrated is a yarn withdrawal apparatus with only one roll 1 serving as the yarn delivery system. The roll 1 is cylindrical and is driven by a turbine, the casing of which is indicated at 8. The roll 1 is rotatably supported in a portable support structure 40, with the direction of rotation of the roll 1 being indicated by arrow 35. Mounted in the support structure 40 is a suction device, which consists substantially of a suction tube 24, which extends parallel to a surface line of the roll 1 and which lies adjacent the surface of the roll 1 so as to be slightly spaced therefrom. The suction tube receives compressed air through a connection line 22, via an annular duct (shown in part) which surrounds the suction tube 24, and several inclined air passages 21 which communicate with the tube 24. As a result, a suction current is generated in the inlet opening 16 of the suction tube 24. Connected to the suction tube 24 is a yarn outlet passage 31, and the yarn is guided as a tangle through the yarn outlet passage to a waste container (not shown).

A yarn delivery tube 14 is provided, which is of angled configuration, and which comprises a first tubular portion 14.1 which is coaxial with the axis of roll 1 and rotatably supported in a bearing 58. The bearing support bore is an integral part of the support structure 40. The tubular portion 14.1 is followed by a second radial tubular portion 14.2 which is bent like a crank, and by a third tubular portion 14.3 which extends parallel to the axis of the roll 1 and likewise substantially parallel to a surface line of the roll, and which is at exactly the same radial distance from the roll axis as is the inlet opening 16 of the suction tube.

The yarn delivery tube 14 may, if desired, be also equipped with compressed-air injectors, which generate an air current in the tube flowing in the desired direction of the yarn path. This may be useful to obtain a high air velocity and to assist the air current in the suction tube, but is usually not necessary, as will become apparent from the following description.

The delivery tube 14 is thus rotatable about the axis of roll 1 in the bearing 58, and the limits of this rotational movement are preset by a stop pin 82. Upon its contact with one side of the stop pin 82, the yarn delivery tube is aligned with the suction tube, which is referred to herein as the yarn catching position. From this position, the portion 14.3 of the entry tube can be rotated in the direction of arrow 83, i.e., counter to the rotational direction 35 of the roll 1, to the so-called drawing-off position, in which the portion 14.3 of the yarn delivery tube and the suction tube 24 are displaced from each other in circumferential direction. The angle by which the delivery tube 14 is rotated, is consequently smaller than 360°. The stop pin 82 is fixedly mounted on the support structure 40 adjacent the bore of the bearing 58.

Up to this point, the embodiments of FIGS. 1, 2, on the one hand, and FIG. 1A, on the other, are identical. They differ, however, in that in the embodiment of FIGS. 1 and 2, the openings of the delivery tube and the suction tube are located closely adjacent a normal plane. Although the diameter of the suction tube 24 and its opening 16 and the diameter of the delivery tube section 14.3 and its opening are illustrated as being identical in the drawings, other diameter ratios are also quite possible. In particular, the diameter of the opening 16 of the suction tube 24 can be larger than that of the opening of the delivery tube portion 14.3. What matters is that the normal planes, in which the openings are located, are very closely adjacent, so that an air current can be generated in the conduit comprising the yarn delivery tube and the suction tube and reliably transport the yarn therethrough.

In the embodiment of FIG. 1A, the openings are not located adjacent a normal plane, but rather they are disposed adjacent an inclined plane. As a result it becomes possible to place the openings of the suction tube and the delivery tube sealingly against each other in the yarn catching position, so that in this position there is no significant leakage at the juncture of the two tubes. This facilitates the passage of the air and a reliable catching of the yarn. The sectional plane, in which the openings are located, is inclined toward the circumferential direction, so that the rotation of the tubular portion 14.3 is not impeded. This arrangement of the openings may also be applied to the embodiment of FIGS. 3 and 4.

Figure 3:
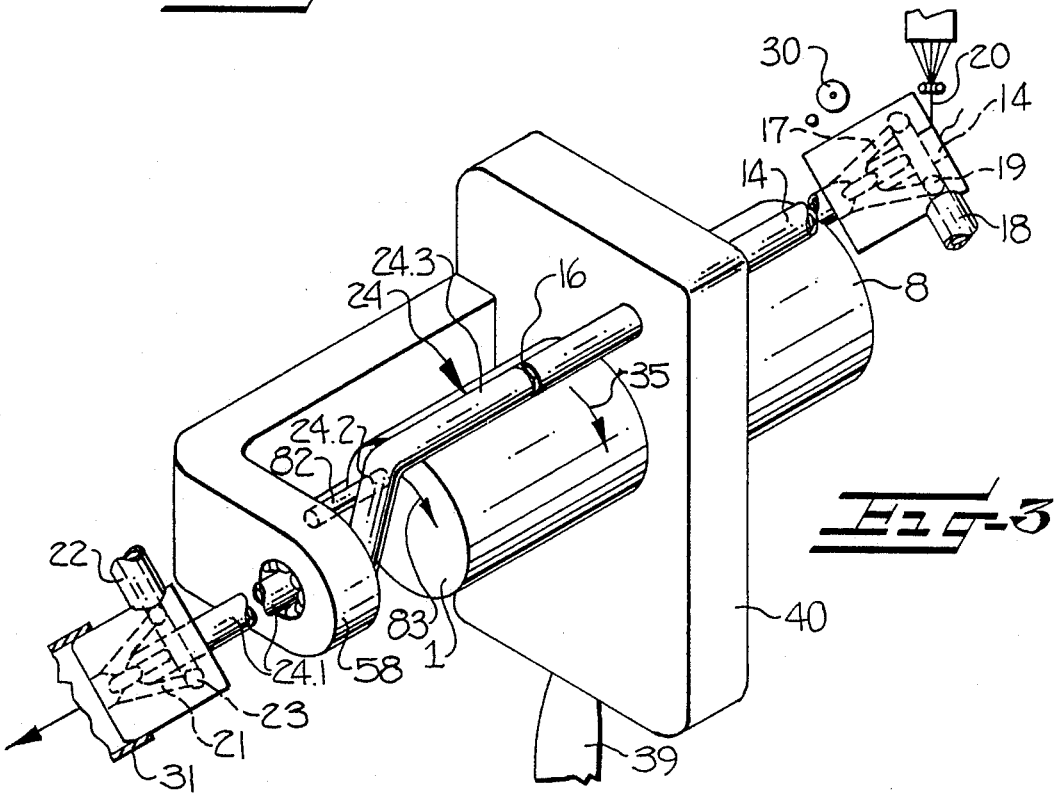
FIGS. 3 and 4 are perspective views of a further embodiment, illustrating the catching position and the drawing-off position respectively.
Figure 4:
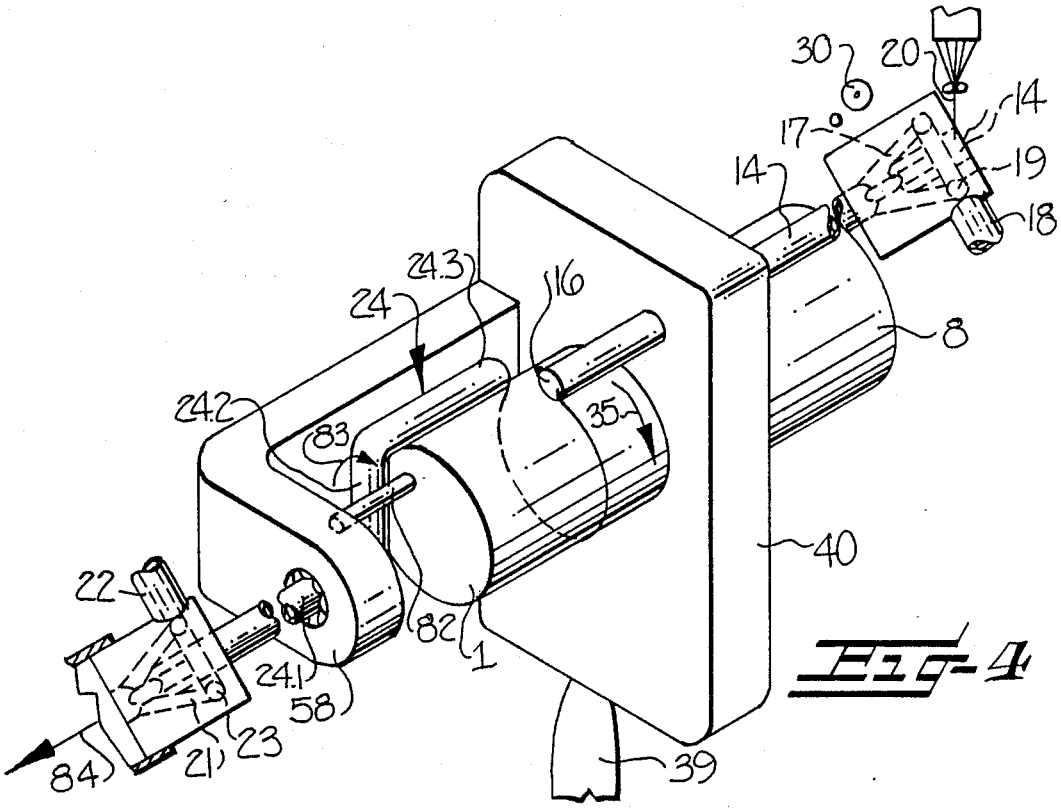

In the embodiment of FIGS. 3 and 4, the yarn withdrawal apparatus again comprises only one roll 1 serving as a yarn delivery system. The roll 1 is driven by a turbine, the casing of which is indicated at 8, and the roll 1 is rotatably supported in a support structure 40. Its direction of rotation is indicated by arrow 35. Mounted in the support structure is a yarn delivery tube 14, which is surrounded by an annular duct which connects to a compressed air inlet 18. Injector nozzles 17 proceed from the annular duct 19, and terminate in the yarn delivery tube 14 with a component in the direction of the advancing yarn. As a result, a suction current is generated in the yarn delivery tube, which allows a yarn length 20 advancing from a spinneret for manmade fibers (indicated in FIGS. 3 and 4) to be caught.

Rotatably supported in a bearing 58 of the support structure 40 is a suction tube 24. To this end, a first portion 24.1 of the suction tube is supported in the bearing 58, coaxial with the axis of roll 1 Following the bearing, the suction tube is bent like crank and provided with a radial tube portion 24.2, and then a tube portion 24.3 extending parallel to the roll 1, and having exactly the same radial distance from the roll axis as the yarn delivery tube 14. The openings of the suction tube 24 and the yarn delivery tube 14 are thus located, relative to the axis of roll 1, on the same radius. As shown here, the openings lie in two closely adjacent normal planes. In this embodiment, the openings can have identical diameters. However, the inlet opening of the suction tube 24 may also be larger than the outlet opening of the delivery tube 14. This is especially advantageous, inasmuch as an additional air current results in the area of the openings, which is directed into the suction tube 24 and favors the advancement of the yarn. It is also possible that the openings of the delivery tube 14 and the suction tube 24 extend so as to be inclined to a normal plane, as is shown for the first embodiment in FIG. 1A.

As aforesaid, the suction tube 24 in FIGS. 3 and 4 is rotatable about the axis of the roll 1. The rotation is limited by a stop pin 82. When the suction tube rests against the one side of the stop pin 82, which is mounted on the support structure 40, it is aligned with the delivery tube 14. The openings of the tubes are then closely adjacent, so that a uniform air circulation results, or, when the openings are obliquely cut, the openings lie sealingly adjacent each other, as is shown in FIG. IA, without impeding the rotational movement. The rotation occurs in the direction of arrow 83 from the yarn catching position to the drawing-off position, with a looping angle smaller than 360°.

The suction tube 24 is provided with an annular duct 23, which surrounds the suction passage. The annular duct 23 is connected with an inlet 22 for compressed air, and inclined injector nozzles 21 proceed from the annular duct 23 and terminate in the suction tube 24 with a component in direction of the advancing yarn. As a result, a suction current is generated in the suction tube 24, which current continues in the catching position from the suction tube 24 into the yarn delivery tube 14, and which is assisted in this embodiment by the compressed-air injectors on the yarn delivery tube 14.

The following description of the operation applies to all embodiments, the characteristics of the individual embodiments being specially noted.

To start up the yarn withdrawal apparatus, the compressed-air connection of the turbine is opened and the roll 1 is brought to rotation. Now, the yarn delivery tube 14 and the suction tube 24 are moved relative to each other to their yarn catching position, so that they are aligned and form a substantially straight yarn passage. Then compressed air is supplied to the injectors 21 via air line 22. As a result, an air current is generated in the passage in the direction of arrow 84. In the embodiment of FIGS. 3 and 4 this air current can be assisted in that compressed air is also supplied to the air line 18 and injector nozzles 17. In any event, a suction current develops at the entry of the yarn delivery tube 14, which continues throughout the entire passage. The air velocity is higher than the yarn speed. To catch a yarn which advances, for example, from a spinning nozzle, it is only necessary that the air flows at least at the speed of the yarn, and it is not necessary that greater impulse forces be exerted on the yarn. The yarn is thus removed through tube 31 to the waste container. However, the air current will not be able to exert such high air forces on the yarn that the yarn could also be placed on the feed system 30 of a processing machine, such as a drafting system. Consequently, a relative rotational movement is effected between the delivery tube 14 and the suction tube 24, and this rotational movement causes the yarn to loop about the roll 1 at an angle corresponding to the angle of the rotation, and to be withdrawn from the spinning nozzle not only by the air forces, but additionally by the frictional forces exerted by the roll. The roll may here be driven at a circumferential speed, which corresponds to the circumferential speed of the yarn feed system 30, i.e., for example, that of a draw roll. Now the yarn may be placed on this draw roll 30 without incurring the risk of a lap formation.

The selection of the circumferential speed and the looping angle about roll 1 makes it possible to ensure that the forces which are exerted by the roll on the yarn, suffice to draw off the yarn from the feed system 30 at such a high speed both while and after being placed thereon, that no laps form on the feed system 30.

It should be again noted that the rotational movement in the embodiments of FIGS. 1 and 2, on the one hand, and of FIGS. 3 and 4, on the other, is different relative to the rotational direction 35 of the roll 1. The rotational direction is predetermined so that no undue yarn tensions occur, in particular, that the yarn cannot again be pulled out of the suction tube 24 after it is caught.

The yarn withdrawal apparatus of the present invention has the advantage over the known types of yarn withdrawal apparatus, in that the catching of the yarn and its looping about the yarn delivery system does not require any special skill, which goes beyond the presently normal operation of a yarn suction gun. It should also be noted that all embodiments are provided with a handle 39 to facilitate the manual handling of the yarn withdrawal apparatus.

In both embodiments, the suction tube (FIGS. 3 and 4) and the delivery tube (FIGS. 1 and 2) respectively may be constructed so as to be straight, rather than angled. The rotational feature is then effected in that the tube rotates parallel to itself about the delivery system. As a result, bends of the tube and both yarn friction and wear are avoided.

An embodiment as described above is shown in FIG. 5. This yarn withdrawal apparatus further differs from those of FIGS. 1–4 in that it has a conical roll 1 serving as yarn delivery system, which is rotatably accommodated in a portable, closed housing 5. A shaft 2, on which the conical roll 1 is fixedly mounted for rotation therewith, is supported in ball bearing 85, of which only one is shown, and which is fitted into a cylindrical sleeve 86 mounted in the housing 5 by means of screws (not shown). The conical roll 1 of FIG. 5 has a hollow internal opening at its larger end, and this opening mounts a turbine wheel 3 on its inside circumference. Formed in the outer surface of the cylindrical sleeve 86 and evenly distributed over its circumference are several axial channels 87, which extend along a substantial portion of its length and terminate in the hollow opening of the conical roll 1. The other ends of the axial channels 87 terminate in the area of an annular duct 88, which is formed in the body of the portable housing 5 and surrounds the cylindrical sleeve 86.

As already indicated above, another substantial difference from the embodiments described in FIGS. 1–4 is that the yarn delivery tube 14 and the suction tube 24 consist of straight, i.e., non-angled, tubular sections, which are aligned with each other in the yarn catching position. The yarn delivery tube 14 axially penetrates through a circular disc 89, which is rotatably mounted in the housing 5 by means of plain bearings 90, so as to be concentric to the axis of rotation of the conical roll 1. A spring ring 91 secures the disc 89 against axial displacement in the housing 5. The yarn delivery tube projects axially into the interior of the housing 5 and is eccentrically arranged in the disc 89, so that in the yarn catching position it is aligned with the suction tube 24, which is mounted in the housing 5 to the same eccentric extent.

In its function as a support of the yarn delivery tube 14, the disc 89 may also be replaced with a lever, which is, for example, rotatably supported on an extension of the shaft 2, or otherwise secured so as to be coaxial with the axis of rotation of the delivery system 1.

Figure 5:
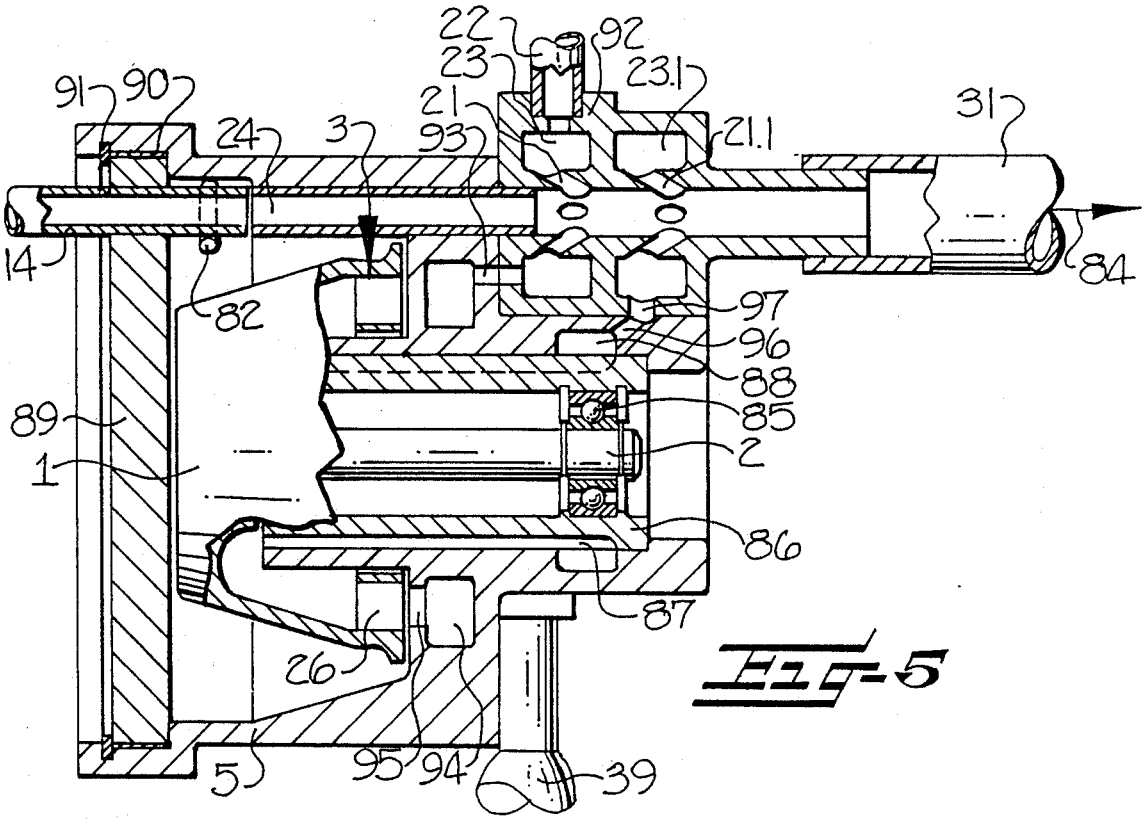
FIG. 5 is a sectional view of another embodiment.

At its right-hand end as seen in FIG. 5, the suction tube 24 is firmly mounted in an air distributing housing 92, which is connected with the housing 5 by screws (not shown). The air distributing housing 92 includes a yarn outlet passage 31 which is substantially concentric to the structure of the housing, and two axially successive annular ducts 23 and 23.1, which are separated by a wall and connected with the yarn outlet passage 31 via injector nozzles 21 and 21.1. Furthermore, the air distributing housing 92 is provided with a compressed-air connection 22, which terminates in the annular duct 23. The annular duct 23 is connected via one or more axially directed bores 93 with another annular duct 94 in the housing 5, which concentrically surrounds the bearing of shaft 2 and thus of the conical roll 1, and which is provided with substantially axially directed openings 95 in the housing 5. These openings 95 may be so directed, or contain baffles, that the air exiting from the annular duct 94 is directed at a favorable angle of incidence onto the blades 26 of the turbine wheel 23.

One portion of the compressed air supplied through air line 22 is guided from the annular duct 23, via the injector nozzles 21 into the yarn outlet passage 31 and serves to draw in the air through the tubes 14 and 24 and to advance the yarn through the yarn outlet passage 31, in the direction of arrow 84, for example, into a waste container.

Another portion of the compressed air supplied through the air line 22 advances through the bores 93 and the annular duct 94 and is employed to drive, via the turbine wheel 3, the conical roll 1 of the yarn delivery system. The air exiting substantially axially from the turbine wheel is so deflected by the flow-favoring cavity of the conical roll 1, that it is guided through the axial channels 87 of the cylindrical sleeve 86 and into the annular duct 88, whence a connecting line 96, 97 advances the air into the annular duct 23.1. From the annular duct 23.1 the air enters through injector nozzles 21.1 into the yarn outlet passage 31 and contributes to the further advancement of the yarn taken in by suction.

Finally, reference is made to the stop pin 82, which is inserted into the inside wall of the housing 5, so that the yarn delivery tube 14 rests in the yarn catching position, i.e, in the position in which it is aligned with the suction tube 24, against the stop pin 82. Thus as illustrated in FIG. 5, the tube lies in front of the stop pin 82.

To effect a nearly complete looping of the conical roll 1 with the yarn taken in by suction, the delivery tube rotates, as already indicated above, parallel to itself about the conical roll 1 of the yarn delivery system. Specifically, it is rotated in the direction of arrow 83 of the FIGS. 3 and 4, together with the disc 89 supported in the plain bearing 90, until it rests, as seen in the drawing, against the rearward side of stop pin 82. Here, the delivery tube 14 itself may serve as a handle. Otherwise, the operation of the yarn withdrawal apparatus of FIG. 5 does not differ from the operation of the embodiments illustrated in FIGS. 1–4.

In the drawings and specification, there has been set forth a preferred embodiment of the invention, and although specific terms are employed, they are used in a generic and descriptive sense only and not for purposes of limitation.

That which is claimed is:

1. In a yarn processing apparatus having means for continuously processing and advancing a yarn along a predetermined path of travel, the combination therewith of an auxiliary yarn withdrawal means for continuously withdrawing the advancing yarn from said predetermined path of travel to facilitate yarn threadup and the like, said yarn withdrawal means comprising a support structure, yarn advancing means mounted to said support structure and comprising at least one rotatable roll, drive means mounted to said support structure for rotating said one roll at a predetermined rotational speed, a yarn delivery tube including a yarn outlet opening, a yarn suction tube including a yarn inlet opening, said inlet opening being disposed to open along a direction which is parallel to the axial direction of said one roll, suction means for drawing air into said suction tube through said inlet opening, and means mounting said yarn delivery tube and said yarn suction tube to said support structure so as to permit relative rotation of said yarn outlet opening and said yarn inlet opening in the circumferential direction about said one roll and between (a) a yarn catching position wherein said yarn outlet opening and said yarn inlet opening are disposed immediately adjacent to each other and aligned along a direction substantially parallel to the axial direction of said one roll, and (b) a drawing-off position, and whereby such relative rotation causes a yarn passing from said yarn delivery tube to said yarn suction tube to be at least partially looped about said one roll.

2. The apparatus as defined in claim 1 wherein said yarn suction tube is mounted at a fixed location with respect to the axis of said one rotatable roll, and said yarn delivery tube is mounted for movement such that said yarn outlet opening is movable circumferentially about the axis of said one roll.

3. The apparatus defined in claim 2 wherein said yarn delivery tube is of angled configuration and includes an initial portion disposed coaxially with the axis of said one roll and mounted to said support structure for rotation about said axis, a radial portion extending radially outwardly from said axis, and an outer portion disposed parallel to but radially spaced from said axis, and with said outlet opening being disposed at one end of said outer portion.

4. The apparatus as defined in claim 3 further comprising a stop pin mounted to said support structure for limiting the rotation of said yarn delivery tube so that the looping angle of the yarn about said one roll is less than 360°.

5. The apparatus as defined in claim 1 wherein said yarn delivery tube is mounted at a fixed location with respect to the axis of said one roll, and said yarn suction tube is mounted for movement such that said yarn inlet opening is movable circumferentially about the axis of said one roll.

6. The apparatus as defined in claim 5 wherein said yarn suction tube is of angled configuration and includes an initial portion disposed coaxially with the axis of said one roll and mounted to said support structure for rotation about said axis, a radial portion extending radially outwardly from said axis, and an outer portion disposed parallel to and radially spaced from said axis, and with said yarn inlet opening being positioned at one end of said outer portion.

7. The apparatus as defined in claim 6 further comprising a stop pin mounted to said support structure for limiting the rotation of said yarn suction tube so that the looping angle of the yarn about said one roll is less than 360°.

8. The apparatus as defined in claim 1 wherein said yarn inlet opening and said yarn outlet opening lie in closely adjacent parallel planes which are normal to said axis of said one roll.

9. The apparatus as defined in claim 1 wherein said yarn inlet opening and said yarn outlet opening lie parallel to and closely adjacent a plane which is inclined with respect to said axis of said one roll.

10. The apparatus as defined in claim 1 wherein said yarn advancing means comprises only said one roll, and said one roll has a cylindrical periphery.

11. The apparatus as defined in claim 1 wherein said relative rotation between said yarn catching position and said drawing off position occurs entirely in a plane normal to the rotational axis of said one roll.

12. An apparatus for withdrawing continuously advancing yarn, and comprising a support housing having an interior chamber, a yarn winding roll mounted to said housing within said chamber for rotation about a central axis, drive means mounted to said housing for rotating said roll about said central axis, a yarn delivery tube including a yarn outlet opening, a yarn suction tube including a yarn inlet opening, suction means for drawing air into said suction tube through said inlet opening, and means mounting said yarn delivery tube and said yarn suction tube to said housing for relative rotation about said central axis and so as to permit relative rotation of said yarn outlet opening and said yarn inlet opening in the circumferential direction about said yarn winding roll and between (a) a yarn catching position wherein said yarn outlet opening and said yarn inlet opening are disposed immediately adjacent to each other and aligned along a direction substantially parallel to said central axis, and (b) a drawing-off position, and whereby such relative rotation causes a yarn passing from said yarn delivery tube to said yarn suction tube to be at least partially looped about said yarn winding roll.

13. The apparatus as defined in claim 12 wherein said means mounting said yarn delivery tube and said yarn suction tube to said housing comprises a disc lying in a plane perpendicular to said central axis, means rotatably mounting said disc to said housing for rotation about said central axis, and wherein one of said yarn delivery tube and said yarn suction tube is mounted to said disc so as to rotate therewith about said central axis.

14. The apparatus as defined in claim 13 wherein said drive means comprises an air turbine connected to said yarn winding roll.

15. The apparatus as defined in claim 14 wherein said air turbine and said suction means are connected to a common air source.

16. The apparatus as defined in claim 14 wherein said suction means comprises first and second separate annular chambers surrounding said yarn suction tube, a plurality of nozzles extending from each of said annular chambers into said yarn suction tube in an inclined direction, and air passage means extending from said first annular chamber through said air turbine and then into said second annular chamber.

* * * * *